United States Patent [19]

Hironaga

[11] Patent Number: 4,597,109

[45] Date of Patent: Jul. 1, 1986

[54] GARMENT

[76] Inventor: Saburo Hironaga, 2910 W. Lingan La., Santa Ana, Calif. 92704

[21] Appl. No.: 531,393

[22] Filed: Sep. 12, 1983

[51] Int. Cl.[4] ..... A41F 19/00; A41B 1/00

[52] U.S. Cl. ..... 2/304; 2/117

[58] Field of Search ..... 2/304, 302, 303, 323, 2/240, 117, 307, 337, 70; 128/535; 24/73

[56] References Cited

U.S. PATENT DOCUMENTS

| | | | |
|---|---|---|---|
| 700,498 | 5/1902 | Hunkins | 2/312 |
| 932,640 | 8/1909 | Pfiffner | 2/117 |
| 1,896,681 | 2/1933 | Peckham | 2/313 |
| 2,801,421 | 8/1957 | Marin | 2/323 |
| 3,331,372 | 7/1967 | Klein | 128/535 |
| 3,542,034 | 10/1970 | Klein | 128/535 |
| 4,074,364 | 2/1978 | Lucero | 2/117 |

*Primary Examiner*—Doris L. Troutman

*Attorney, Agent, or Firm*—Harvey C. Nienow

[57] ABSTRACT

A garment to be worn by human beings comprising a trunk portion to which is attached one end of each of a pair of elastromeric extensions, each of the other ends thereof carrying a button. Said button has an enlarged end portion, and a clip is provided to engage a reduced portion of such button after the fabric or cloth material of a shirt is caused to at least partially encircle such button.

8 Claims, 5 Drawing Figures

GARMENT

The present invention relates generally to garments, but more particularly to pieces of clothing worn by human beings which are adapted to be interconnected with other garments.

Today's typical dress in the western world, particularly for men, comprises trousers or pants which are casued to fit snugly around the waist or beltline of the wearer, and a shirt which covers the upper portion of the body and which is inserted into the trousers. As a person wearing such western garb moves his or her torso such as bending over or stretching or the like, it is not uncommon for the shirt to be pulled out from its desired position within the trousers. Sometimes the shirt is merely caused to bulge by such movements of the wearer, and yet, on many occasions, the entire shirttail is pulled out of the trousers.

This result is particularly objectionable in certain formal settings, such as where individuals are wearing military or other formal clothing, the loose or bulging shirttail being an unkempt condition which is undesirable. Rather, for certain situations, as for instance during periods of close physical inspection, it is desirable for the military person to have his or her shirt strongly and firmly tucked within the trousers.

Notwithstanding this desire, it has been difficult to maintain such conditions, most particularly because of the natural and normal physical motions of the wearer. As such, it has been long sought after to have means whereby a person's shirt is held firmly within the trousers while nonetheless permitting a certain amount of motion on the part of the wearer.

In view of the foregoing, it is an object of the present invention to provide a garment which is capable of retaining the wearer's shirttail within the wearer's trousers.

It is another object of the present invention to provide a garment as characterized above which is a piece of underclothing adapted with fastening means for gripping and retaining the shirttail within the trousers.

Another object of the present invention is to provide a garment as characterized above which is provided with means which are formed of elastomeric material such that the normal movements of the wearer enable the shirttail to be pulled from the trousers but thereafter the shirttail is returned to its fully "tucked in" position.

An even further object of the present invention is to provide a garment as characterized above which is in the form of undershorts having a trunk portion to which are attached elastic extensions to be attached to the wearer's undershirt.

A still further object of the present invention is to provide a garment as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawing.

Figure 1:
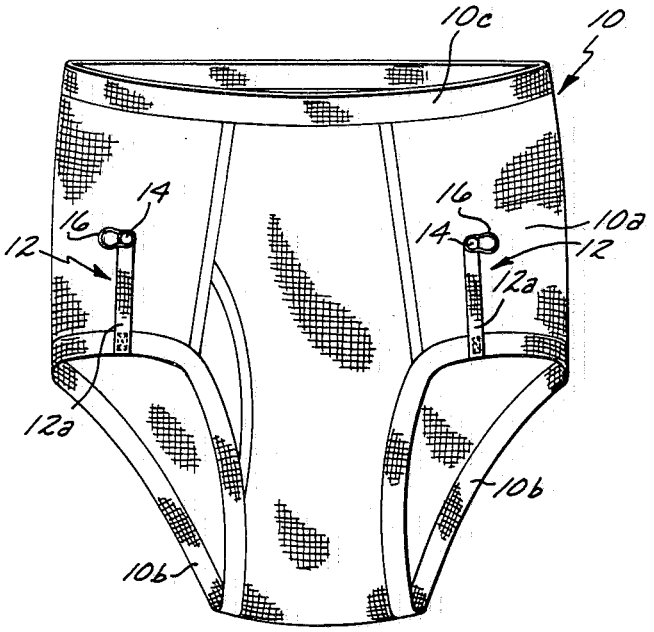
FIG. 1 is a front plan view of a garment according to the present invention.

Referring to FIG. 1 of the drawings, there is shown therein a garment 10 formed in accordance with the present invention. Such garment 10 comprises a trunk portion **10*a* and is provided with a pair of leg openings 10*b*. Such trunk portion 10*a* has the usual elastic waistband 10*c* which causes the garment 10** to closely conform to the wearer's waist or hipline.

Figure 2:
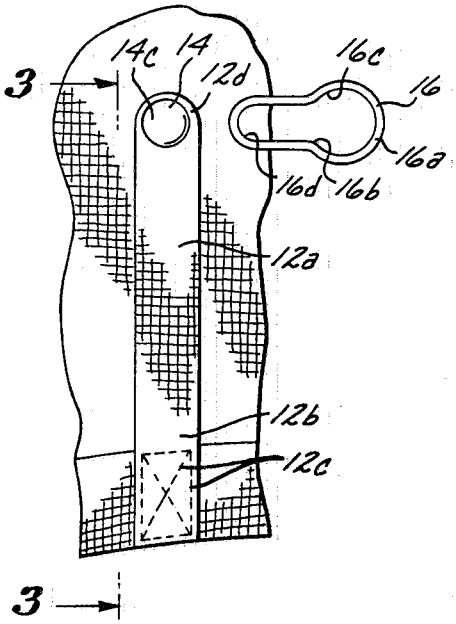
FIG. 2 is a fragmentary view of a portion of the garment of FIG. 1.
Figure 3:
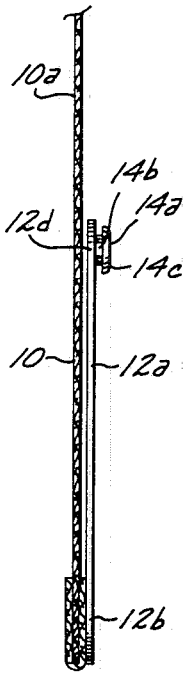
FIG. 3 is a fragmentary sectional view through the garment of FIG. 1.

Attached to the trunk portion **10*a* of garment are a pair of connection devices 12, each of which, as shown most particularly in FIGS. 2 and 3 of the drawings, comprises an extension 12*a* formed of elastomeric material. Each such extension 12*a* has an end portion 12*b* which is fastened to the trunk portion 10*a* of garment 10 by means of stitching 12*c*. The opposite end 12*d* of each extension is provided with a button 14 which, as shown most particularly in FIG. 3 of the drawings, is provided with an enlarged end portion 14*a* and a reduced portion 14*b*. Such button is firmly secured to end 12*d* of extension 12*a* by any appropriate means such as by swaging or bending of the end of the button 14 after it is extended through the elastic material of extension 12*a***.

Button 14 is formed with a coating **14*c* which is at least moderately resilient and which covers both the enlarged end 14*a* and the reduced portion 14*b***.

A clip 16 formed of any appropriate material such as metal, plastic or the like, is provided for engagement with the button 14, as will hereinafter appear. Such clip is formed with a continuous edge member **16*a* having an oblong opening 16*b* therewithin. More specifically, the opening of clip 16 comprises a circular portion 16*c* which is of such size as to pass the enlarged end portion 14*a* of button 14 when the latter is covered with fabric or cloth material, and a smaller extension 16*d* which is capable of engaging the reduced portion 14*b* of button 14** as will hereinafter appear.

Figure 4:
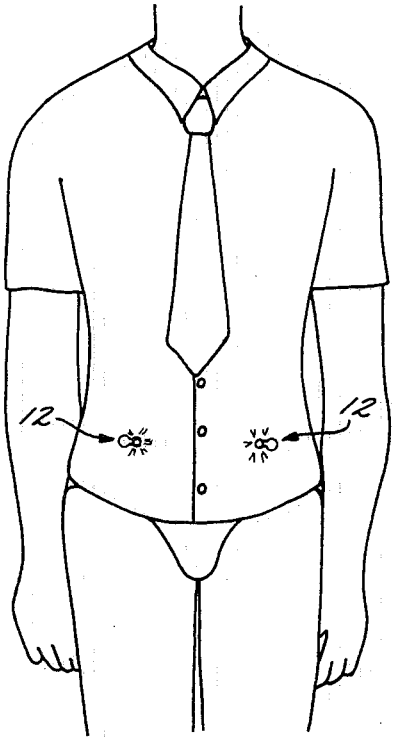
FIG. 4 is a front view of a wearer of the garment.
Figure 5:
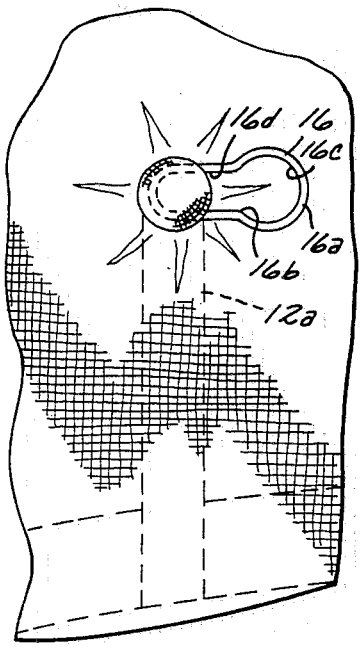
FIG. 5 is a fragmentary view showing the garment attached to the wearer's shirttail.

When it is desired to utilize the garment 10 shown in FIG. 1, it is merely necessary for the wearer to allow his or her shirttails to fall over the buttons 14 of the several devices 12. Then, with the cloth material of the shirttails wrapped about each of the buttons 14, a separate one of the clips 16 is positioned as shown in FIGS. 4 and 5. To accomplish this, the opening **16*c* of each clip 16 is passed over the enlarged end 14*a* of the respective button 14 with the shirttail material thereabout, and then the clip is moved such as to cause the edge member at the elongated opening 16*d* to firmly grip the shirttail and reduced portion 14*b* of button 14. Under these conditions, the wearer's shirttail is firmly secured to the various elastic extensions 12*a***.

It is thus seen that the wearer can move freely without causing the shirttail to be pulled from the wearer's trousers, the elastic nature of the extensions **12*a*** firmly returning such shirttail to the desired "tucked in" position.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. A garment comprising in combination, means adapted to be worn by a human being and formed with a trunk portion and a pair of leg openings, one or more extensions formed of elastomeric material and individually fixed to said trunk portion to extend upwardly of said trunk portion, a button on each of said extensions, and a clip for each button separate and unattached to said garment, garment extensions or buttons when not in use but adapted to engage the button when the respective button is at least partially encircled by fabric material from another garment worn by said human being above said trunk portion.

2. A garment according to claim 1 wherein each of said extensions is elongated having one end attached to said trunk portion and another end provided with said button.

3. A garment according to claim 2 wherein said button is formed with an enlarged end portion and a reduced portion adjacent said extension.

4. A garment according to claim 3 wherein said clip engages said reduced portion of said button to thereby retain said fabric material fixed thereto.

5. A garment according to claim 4 wherein said clip is formed with a continuous edge member forming a generally oblong opening therewithin.

6. A garment according to claim 5 wherein said edge member of said clip is so formed as to provide a relatively large opening for passage therethrough of said button and fabric material and a relatively small opening extending from said large opening for engaging said reduced portion of said button.

7. A garment according to claim 6 wherein said one end of each of said extensions is stitched to said trunk portion.

8. A garment according to claim 7 wherein said button includes a coating of resilient material on said reduced portion to enable said clip to firmly grip said reduced portion with the fabric material thereon.

* * * * *